US007808518B2

(12) United States Patent
Nakai et al.

(10) Patent No.: US 7,808,518 B2
(45) Date of Patent: Oct. 5, 2010

(54) INK SHEET CARTRIDGE

(75) Inventors: Takashi Nakai, Fukushima-ken (JP); Yasutoshi Inoue, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 866 days.

(21) Appl. No.: 11/689,928

(22) Filed: Mar. 22, 2007

(65) Prior Publication Data

US 2007/0222849 A1 Sep. 27, 2007

(30) Foreign Application Priority Data

Mar. 22, 2006 (JP) ..... 2006-078750

(51) Int. Cl.
*B41J 32/00* (2006.01)
*B41J 35/28* (2006.01)

(52) U.S. Cl. ..... 347/214; 347/216; 400/207

(58) Field of Classification Search ..... 347/214, 347/216; 400/207, 208, 247, 246
See application file for complete search history.

(56) References Cited

U.S. PATENT DOCUMENTS 4,978,240 A * 12/1990 Katsuno ..... 400/224.2
5,110,228 A * 5/1992 Yokomizo ..... 400/208
6,504,564 B1 * 1/2003 Funaki et al. ..... 347/214
7,217,047 B2 * 5/2007 Maruyama ..... 400/207

FOREIGN PATENT DOCUMENTS

JP 5-155122 6/1993
JP 11-342655 * 12/1999
JP 3496267 11/2003

* cited by examiner

*Primary Examiner*—Anh T. N. Vo
(74) *Attorney, Agent, or Firm*—Brinks Hofer Gilson & Lione

(57) ABSTRACT

There is provided an ink sheet cartridge that includes a cartridge case having a case body disposed opposite to an upper surface of an ink sheet unit, driving sidewall portions rotatably supporting driving shafts of respective sheet supply and winding bobbins, and a supporting sidewall portion to rotatably support supporting shafts of respective sheet supply and winding bobbins. The ink sheet unit is detachably insertable in the case body, receives an ink sheet wound around the sheet supply bobbin, and includes a supply sheet case capable of drawing out the ink sheet therefrom at the time of receiving the ink sheet. The ink sheet cartridge enables replacement of the ink sheet unit such that the cartridge case is reusable and protects the replacement ink sheet from foreign objects and substances.

21 Claims, 5 Drawing Sheets

INK SHEET CARTRIDGE

This application claims the benefit of priority under 35 U.S.C. §119 to Japanese Patent Application No. 2006-078750 filed on Mar. 22, 2006, which is hereby incorporated by reference in its entirety.

BACKGROUND

1. Field of the Invention

The present disclosure relates to an ink sheet cartridge, and more particularly, to an ink sheet cartridge used in a line thermal printer for printing a print image.

2. Description of the Related Art

In general, a line thermal printer having a longitudinal thermal head, and heater elements of which are arranged in a width direction of a printing paper, is used as a printer which promptly performs a printing operation line-by-line or page-by-page on a printing paper.

An ink sheet cartridge which receives an ink sheet unit in a cartridge case is fitted into the line thermal printer as an ink sheet cartridge for the line thermal printer.

The ink sheet cartridge includes a longitudinal ink sheet of which a coloring region is continuously applied with ink of colors yellow, magenta, cyan, or the like. One end of the ink sheet is wound around a sheet supply bobbin of a cylindrical shape while the other end of the ink sheet is wound around a winding bobbin of a cylindrical shape. In addition, the cartridge case includes upper and lower halves made of a synthetic resin, which are bonded or engaged with each other by an ultrasonic welding or a snap-in method.

A known ink sheet cartridge allows the ink sheet unit to receive the sheet supply and winding bobbins to be rotatable in the cartridge case.

However, in an ink sheet cartridge formed by bonding the upper and lower halves with each other so as to form the cartridge case, it is difficult to reuse the cartridge case as the cartridge case needs, inevitably, to be broken to replace a used ink sheet unit with an unused ink sheet unit. Likewise, in an ink sheet cartridge formed by engaging the upper and lower halves with each other in terms of the snap-in method, it is difficult for a common user to reuse the cartridge case as a tool for detaching the engaged halves by the snap-in method, or a certain degree of skill, is necessary to replace the ink sheet unit.

Additionally, in the ink sheet unit of the known ink sheet cartridge, the coloring region applied with the ink of yellow, magenta, cyan, or the like color is exposed. Because of this, even when it is possible to detach the upper and lower halves to replace the ink sheet unit, there is a concern of touching a wound part of the ink sheet in the sheet supply bobbin or the sheet winding bobbin with a hand or finger, etc., so that a foreign substance such as dust can be attached to, or a flaw created on, the coloring region of the ink sheet. Therefore, when an image is printed by using the above-mentioned ink sheet, a failure or glitch in the transfer of the ink results in an unsatisfactory image print.

Examples of such an ink sheet cartridge are disclosed in Japanese Patent No. 3496267 and Japanese Unexamined Patent Application Publication No. 5-155122.

SUMMARY

The present disclosure is contrived in consideration of the above-mentioned problems. Various objects of the disclosure include, but are not limited to, providing an ink sheet cartridge of which: an ink sheet unit can be easily replaced, an effective utilization of resources can be achieved because the reuse of a cartridge case is possible, and printing a satisfactory, if not higher quality, image can be obtained by preventing foreign substances from attaching on an ink sheet and preventing flaws from being made on the ink sheet when replacing the ink sheet unit.

To achieve at least some of the above objects, there is provided an ink sheet cartridge having an ink sheet unit including a sheet supply bobbin on which a longitudinal ink sheet is wound from one end thereof and a sheet winding bobbin on which the longitudinal ink sheet is wound from the other end. A cartridge case detachably receives the ink sheet unit, wherein the cartridge case includes a case body having a central opening portion disposed opposite to a main surface of the ink sheet unit so as to expose the ink sheet from the center thereof; first and second driving sidewall portions disposed on one side of the case body so as to rotatably support corresponding first and second driving shafts disposed on one end of the sheet supply and winding bobbins, respectively; and first and second supporting sidewall portions disposed on the other side of the case body so as to rotatably support corresponding supporting shafts disposed on the other end of the sheet supply and winding bobbins, respectively. The ink sheet unit includes a sheet case that receives the ink sheet wound around the sheet supply bobbin, such that the ink sheet is drawn from the sheet supply bobbin through a central slit opening of the sheet case to be wound around the sheet winding bobbin.

An ink sheet cartridge according to one embodiment includes a case body disposed on the main surface of an ink sheet unit, a driving sidewall portion, and a supporting sidewall portion disposed in a semi-open type structure so as to receive and hold the ink sheet unit when the cartridge case is inserted into a printer. Because the ink sheet cartridge has the semi-open type structure, it does not require labor or skill to disassemble the cartridge case, thereby making it easy to replace and recover the ink sheet unit.

According to an ink sheet cartridge of the disclosure, because a part of the ink sheet (wound around at least the sheet supply bobbin) is coated with a sheet case, it is possible to prevent a hand or the like from directly touching a part that is wound around the sheet supply bobbin. The part is an unused part in a coloring region of the ink sheet unit when replaced and recovered.

According to an ink sheet cartridge of the disclosure, an end opening portion to expose the sheet case is disposed on a part opposite to the sheet case in the case body. This arrangement of the end opening portion and the sheet case reduces the amount of material used in manufacturing the case body as well as the amount of waste from scraping the cartridge case.

According to an ink sheet cartridge of the disclosure, a locking protrusion is disposed on a supporting sidewall and in opposition to the supporting sidewall portion of the sheet case. A holding member is to hold the sheet case is disposed on, and moveable in parallel with, an inner surface of the supporting sidewall portion. The holding member includes a locking claw having a locking portion locked to the locking protrusion, a guiding slope being formed on an edge of the locking claw so as to guide the locking protrusion to the locking portion while moving the holding member to abut against the locking protrusion when the cartridge case receives the ink sheet unit.

An ink sheet cartridge according to another embodiment includes a sheet case having a first driving sidewall portion coupled to a first end of the sheet case and a first supporting sidewall portion coupled to a second end of the sheet case to rotatably support, respectively, corresponding driving and supporting shafts of a sheet supply bobbin within the sheet case. A case body has supply and winding dome portions at respective first and second ends thereof, the supply dome portion for detachable insertion therein of the sheet case through an end opening portion of the case body, and the winding dome portion for detachable insertion therein of a sheet winding bobbin. A second driving sidewall portion is coupled to a first side of the winding dome portion, and a second supporting sidewall portion is coupled to a second side of the winding dome portion to rotatably support, respectively, corresponding driving and supporting shafts of the winding supply bobbin. An ink sheet has a first end wound around the sheet supply bobbin and threaded through a central slit opening defined along the side of the sheet case, and having a second end wound around the sheet winding bobbin.

In this embodiment, an ink sheet unit includes the sheet case having therein the sheet supply bobbin, the sheet winding bobbin, and the ink sheet, wherein the ink sheet unit is detachable from the case body.

In addition, it is possible to prevent a foreign substance, such as a dust, from being attached on an unused part of the coloring region of the ink sheet. Accordingly, the various embodiments help to prevent a transfer failure of the ink from the ink sheet caused by the attachment of foreign substances thereon, thereby enabling the printing of higher quality images.

DESCRIPTION OF THE PREFERRED EMBODIMENTS

Hereinafter, an ink sheet cartridge according to an embodiment of the invention will be described with reference to FIGS. 1 through 9.

Figure 1:
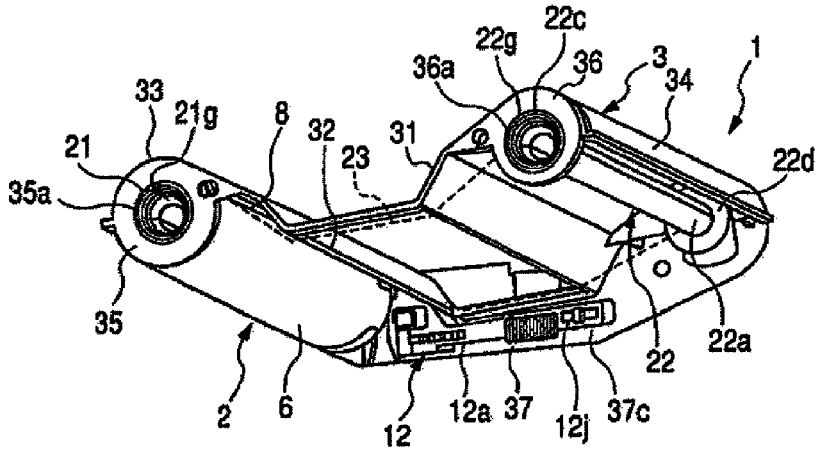
FIG. 1 is a perspective view illustrating an ink sheet cartridge according to the present disclosure.
Figure 2:
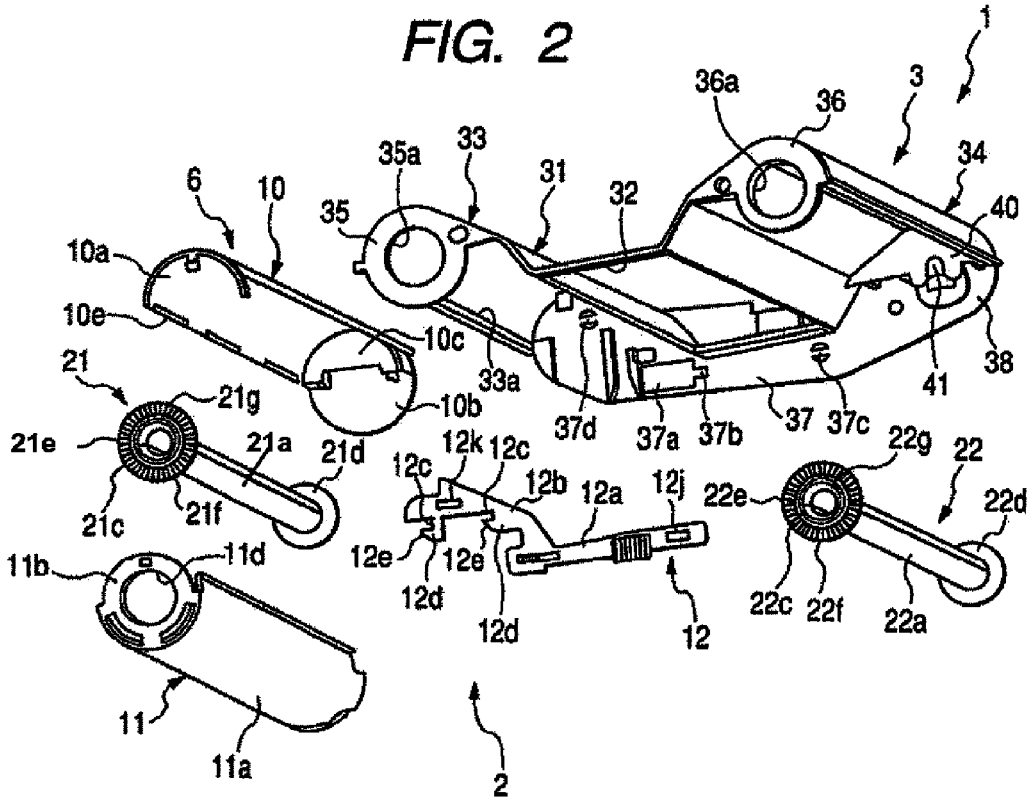
FIG. 2 is an exploded perspective view illustrating an ink sheet unit and a cartridge case of the ink sheet cartridge as shown in FIG. 1.

FIG. 1 is a perspective view illustrating the ink sheet cartridge according to one embodiment. FIG. 2 is an exploded perspective view illustrating the ink sheet cartridge as shown in FIG. 1.

As shown in FIGS. 1 and 2, an ink sheet cartridge 1 according to the disclosure includes an ink sheet unit 2 and a cartridge case 3 to receive the ink sheet unit 2.

The ink sheet unit 2 includes a longitudinal ink sheet 23 of which a coloring region is sequentially and continuously applied with ink of yellow (Y), magenta (M), and cyan (C) colors. The ink sheet unit 2 also includes a sheet supply bobbin 21 on which the ink sheet 23 is wound from one end thereof, and a winding bobbin 22 on which the ink sheet 23 is wound from the other end thereof.

Additionally, the sheet supply and winding bobbins 21 and 22 of the ink sheet unit 2 are made of a resin cylindrical member, and include cylindrical-shaped base portions 21*a* and 22*a* disposed at the center thereof a supporting shaft having a smaller outer diameter than that of the base portions 21*a* and 22*a* disposed on one end of the base portions 21*a* and 22*a*, and driving shafts 21*c* and 22*c* having a larger outer diameter than that of the base portions 21*a* and 22*a* disposed on an outer end of the base portions 21*a* and 22*a*.

One end of the unused ink sheet 23 is wound around the base portion 21*a* of the sheet supply bobbin 21 and the other end of the ink sheet 23 is wound around the base portion 22*a* of the sheet winding bobbin 22.

The supporting and driving shafts 21*c* and 22*c* include a lower guard-shaped flange abutting against the base portions 21*a* and 22*a*, respectively (e.g., flanges 21*d* and 22*d* of the supporting shafts, and flanges 21*e* and 22*e* of the driving shafts 21*c* and 22*c*). Rectangular-shaped grooves 21*f* and 22*f* of a plurality teeth used as a fitting portions are radially arranged around the shaft on the outer wall surface of the flanges 21*e* and 22*e*, which are disposed on the driving shafts 21*c* and 22*c*. Theses fitting grooves 21*f* and 22*f* receive corresponding gripping protrusions (not shown) on the inner wall of driving sidewall portions (11*b* and 36 discussed further below).

On an inner surface of the driving shafts 21*c* and 22*c*, locking protrusions 21*g* and 22*g* are formed to lock to a driving system of a printer (not shown) that transmits rotary power for rotating the sheet supply and winding bobbins 21 and 22. The driving system of the printer is locked to the locking protrusions 21*g* and 22*g* so as to transmit rotary power to the sheet supply and winding bobbins 21 and 22.

Additionally, the ink sheet unit 2 includes the supply-side sheet case 6 that receives a part of the ink sheet 23 wound around the sheet supply bobbin 21.

The sheet case 6 is formed of a resin material (or the like), and is cylindrical in shape. The supply-side sheet case 6 includes upper and lower cases 10 and 11.

Figure 3:
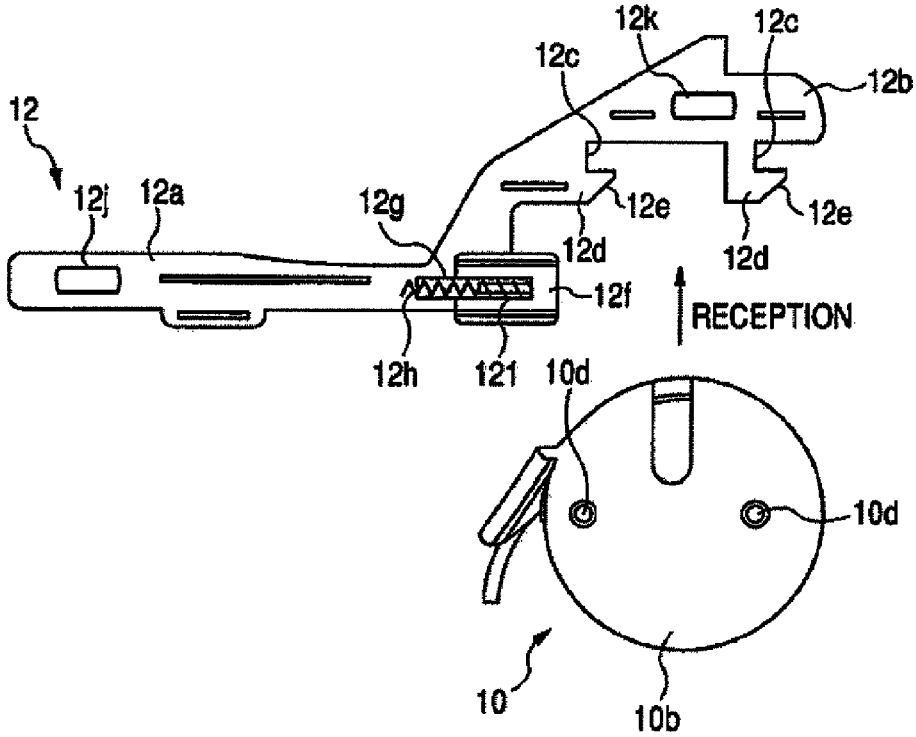
FIG. 3 is a side view illustrating an unlocked state of a holding member and a sheet case of the ink sheet cartridge as viewed from a supporting sidewall portion as shown in FIG. 1.
Figure 4:
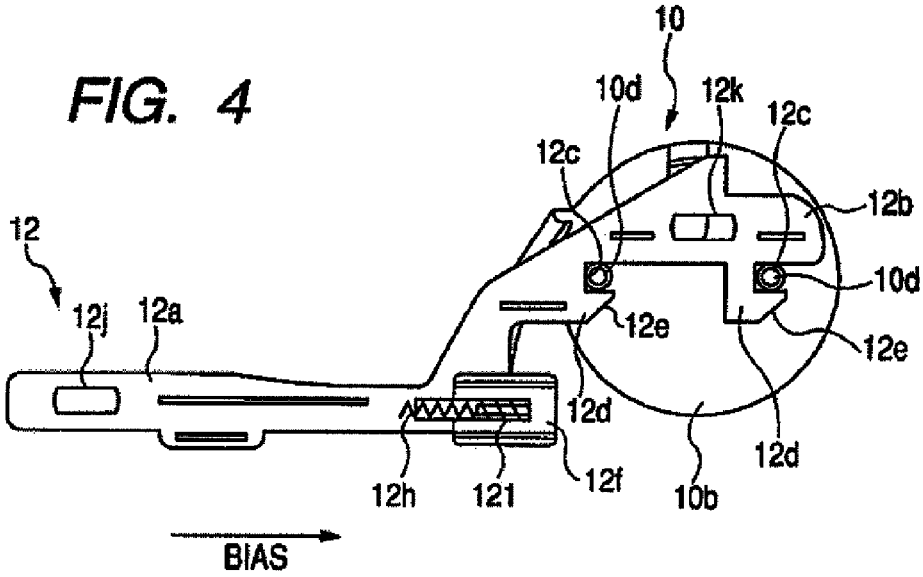
FIG. 4 is a schematic side view illustrating a locked state of the holding member as shown in FIG. 3, and the sheet case as viewed from the supporting sidewall portion.

The upper case 10 includes a semi-cylindrical shaped upper wall 10*a* which is disposed opposite to an upper surface side of the ink sheet 23 (wound around the sheet supply bobbin 21) and a cylindrical-shaped supporting-side wall 10*b*, which is disposed opposite to a supporting shaft side of the sheet supply bobbin 21. In the supporting-side wall 10*b* side with reference to the upper wall 10*a*, an upper side bearing 10*c* is disposed in parallel with the supporting-side wall 10*b* and locked to the flange 21*d* of the sheet supply bobbin 21 so as to rotatably support the supporting shaft. In addition, at the outer surface of the supporting-side wall 10*b*, a plurality of locking protrusions 10*d*, e.g., two locking protrusions 10*d* are disposed longitudinally along the width direction of the supporting-side wall 10*b* as shown in FIGS. 3 and 4 according to one embodiment.

In addition, the lower case 11 includes a semi-cylindrical shaped lower wall 11*a* which is disposed opposite to a lower part of the ink sheet 23 (wound around the sheet supply bobbin 21) and a cylindrical-shaped driving-side sidewall

11*b* which is disposed opposite to the driving shaft 21*c* side of the sheet supply bobbin 21. In the supporting-side wall 10*b* with respect to the lower wall 10*a*, a lower side bearing (not shown) is formed and locked to the flange 21*d* of the sheet supply bobbin 21 so as to rotatably support the supporting shaft. In addition, at the center part of the driving-side sidewall 11*b*, a cylindrical-shaped donut bearing 11*d* is formed so as to rotatably support the driving shaft 21*c* of the sheet supply bobbin 21.

The upper and lower cases 10 and 11 form a single body by locking a locking portion 10*e* formed on an end of the upper case 10 into a locking portion (not shown) formed on an end of the lower case 11 corresponding to the one end of the upper case 10.

Additionally, in the supply-side sheet case 6, an opening portion 8 is formed at the gap between edges of the upper and lower cases 10 and 11, extending longitudinally of the sheet case 6 so as to draw the ink sheet 23 out of the sheet winding bobbin 22.

Meanwhile, a cartridge case 3 includes a case body 31 disposed in opposition to an upper surface of the ink sheet unit 2 and made of a plate-shaped member. A window frame-shaped central opening portion 32 is formed at the center part of the case body 31 so as to allow a printing portion (not shown) of the printer to abut against the ink sheet 23, which is thereby tensely stretched between the sheet supply and winding bobbins 21 and 22.

On one end of the case body 31 (in opposition to the sheet supply bobbin 21), a supply dome portion 33 is formed in a bent semi-cylindrical shape so as to receive the supply-side sheet case 6. At the part of the supply dome portion 33 opposed to the supply-side sheet case 6, a window frame-shaped supply-side 33*a* is formed so as to expose the upper surface of the supply-side sheet case 6. Meanwhile, on the other end of the case body 31 (opposite from the sheet winding bobbin 22), a winding dome portion 34 is formed in a bent semi-cylindrical shape so as to receive the sheet winding bobbin 22 around which the ink sheet 23 is wound.

On one end of the case body 31, a cylindrical-shaped driving-side sidewall portion 35 is formed that rotatably supports the driving shaft 21*c* of the sheet supply bobbin 21 and corresponds to the supply dome portion 33. On the other end of the case body 31, a cylindrical-shaped driving-side sidewall portion 36 is formed that rotatably supports the driving shaft 22*c* of the sheet winding bobbin 22, and corresponds to the winding dome portion 34.

On the center part of the wall surface of the driving sidewall portions 35 and 36, donut-shaped bearings 35*a* and 36*a* are formed so as to rotatably support the driving shafts 21*c* and 22*c* of the sheet supply or winding bobbins 21 or 22.

In addition, on the other side of the case body 31, a supporting-side sidewall portion 37 is formed so as to support the supporting-side wall 10*b* of the supply-side sheet case 6 and to rotatably support the supporting shaft 22*b* disposed on the other end of the sheet winding bobbin 22.

Figure 5:
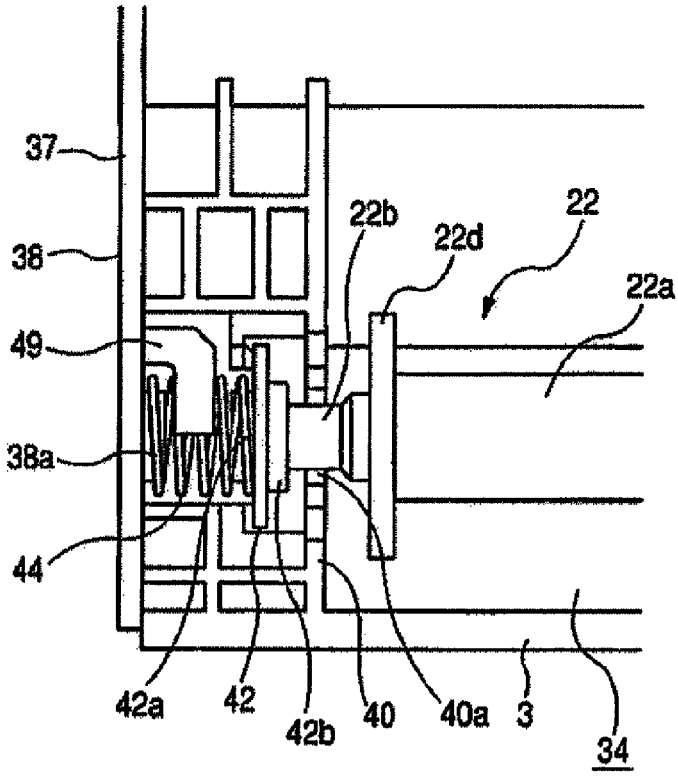
FIG. 5 is a top plan view illustrating a main part of the supporting sidewall portion in the ink sheet cartridge as shown in FIG. 1.
Figure 6:
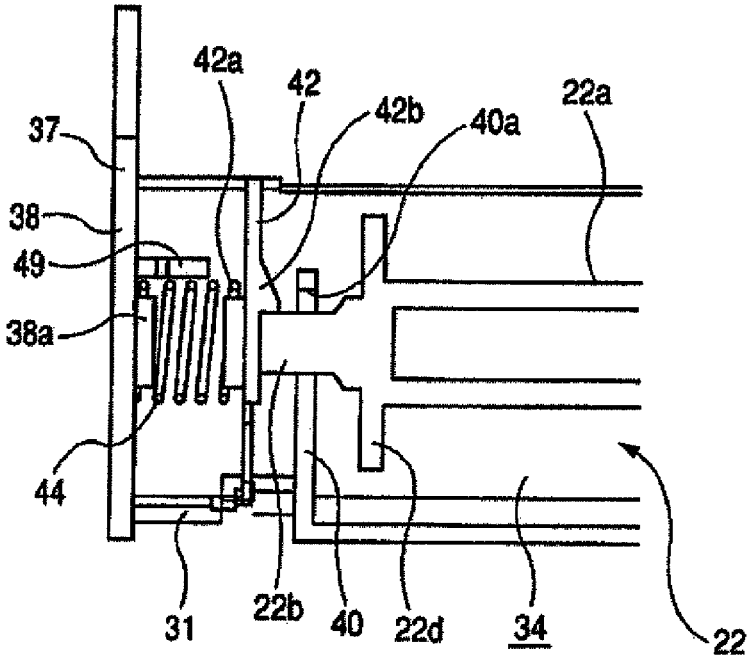
FIG. 6 is a sectional view illustrating the main part of the supporting sidewall portion in the ink sheet cartridge as shown in FIG. 1.

As shown FIGS. 5 and 6, the part of the supporting-side sidewall portion 37 that supports the supporting shaft 22*b* includes: an outer wall portion 38 forming the outer wall of the cartridge case 3; an inner wall portion 40 having a predetermined gap in parallel with the outer wall portion 38 inside the winding dome portion 34 of the cartridge case 3; and a central wall portion 42 disposed in parallel with the outer wall portion 38 at the gap between the outer wall portion 38 and the inner wall portion 40.

On the inner wall portion 40 of the supporting-side sidewall portion 37, a U-shaped bearing 40*a* is opened on an end of the inner wall portion 40 so as to slide within it the supporting shaft 22*b* of the sheet winding bobbin 22.

Additionally, a convex-shaped locking portion 38*a* is formed on the inner wall surface of the outer wall portion 38 so as to lock in one end of a spring member 44. A convex-shaped locking portion 42*a* is formed on the outer wall surface of the central wall portion 42 so as to lock in the other end of the spring member 44. That is, the spring member 44 is disposed between the outer and central wall portions 38 and 42 by allowing both ends thereof to lock in the locking portions 38*a* and 42*a*.

Here, the central wall portion 42 is a plate-shaped member of which its base is fixed in the case body 31, and formed in a bar-shape having a cantilever which enables the end to be flexible in a direction of the end perpendicular to the outer wall 38. As the flexibility is released, the supporting shaft 22*b* of the sheet winding bobbin 22 abuts against the inner wall surface of the central wall portion 42, and therefore, the sheet winding bobbin 22 is able to be biased to the driving-side sidewall portion 36.

In addition, a guiding wall surface (not shown) is formed on the inner wall surface of the central wall portion 42 in a slope rising from an end of the central wall portion 42 to a base portion thereof. A guiding protrusion 42*b*, also formed in the inner wall surface of the central wall portion 42, has a locking surface extending perpendicular to the inner wall surface of the central wall portion 42 and in parallel with the inner wall surface of the case body 31. Also, an end of the central wall portion 42 is made as a gripper portion for a user to manipulate the central wall portion 42.

Also, on the supporting-side sidewall portion 37, a flat L-shaped protrusion 49 includes an end connected to the inner wall surface of the outer wall portion 38. The other end of the L-shaped protrusion 49 extends in parallel with the case body 31 in the space above the spring member 44 (between where the central wall portion 42 approaches near the outer wall portion 38) and against the pressing force of the outer wall portion 38 and the spring member 44.

On an inner surface of the supporting-side sidewall portion 37, a holding member 12 is attached so as to support the supply-side sheet case 6.

The holding member 12 includes a base portion 12*a* disposed on the center part of the supporting-side sidewall portion 37 and an arm portion 12*b* extended so as to be disposed on the part in opposition to the supporting-side wall 10*b* of the supply-side sheet case 6. A first locking aperture 12*j* is formed on a winding-side end of the base portion 12*a* on which the sheet winding bobbin 22 is disposed, longitudinally in a direction corresponding to the movement of the holding member 12 between the supply and winding sides as shown in FIGS. 7 and 8.

Additionally, a second locking base portion 12*k* is longitudinally formed as was the first locking aperture 12*j*, but on a supply-side end of the arm portion 12*b*.

Locking clamps 37*c* and 37*d* that protrude from the supporting-side sidewall portion 37 are formed in correspondence with, and for insertion into, locking apertures 12*j* and 12*k* on the inner surface of the supporting-side sidewall portion 37. In this way, the holding member 12 is attached to the inner surface of the supporting-side sidewall portion 37 by allowing the locking clamps 37*c* and 37*d* to lock in the respective locking apertures 12*j* and 12*k*.

Figure 7:
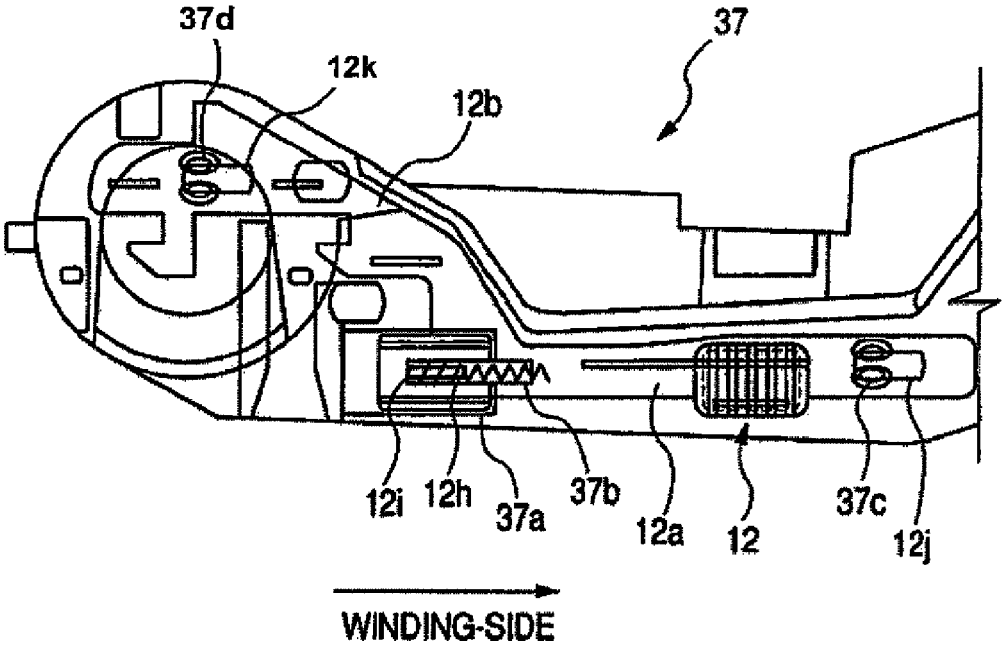
FIG. 7 is a side view illustrating the holding member as shown in FIG. 3 moved toward a winding side as viewed from an inside of the cartridge case.
Figure 8:
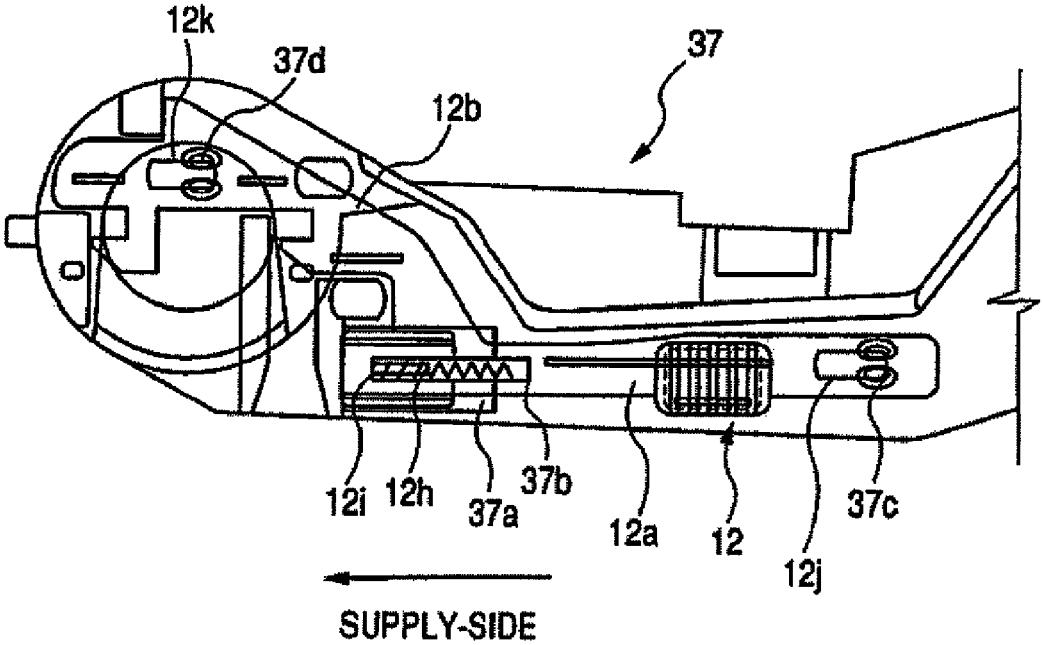
FIG. 8 is a side view illustrating the holding member as shown in FIG. 3 moved toward a supply side as viewed from the inside of the cartridge case.

As shown in FIGS. 7 and 8, the holding member 12 is able to move within the locking range of which the locking clamps 37*c* and 37*d* are locked to the longitudinal locking apertures 12*j* and 12*k* formed in the above direction by using the locking clamps 37*c* and 37*d* as a guide. Thus, the holding member 12 is attached so as to be able to move between the supply side and the winding side along the inner surface of the supporting-side sidewall portion 37.

Figure 9:
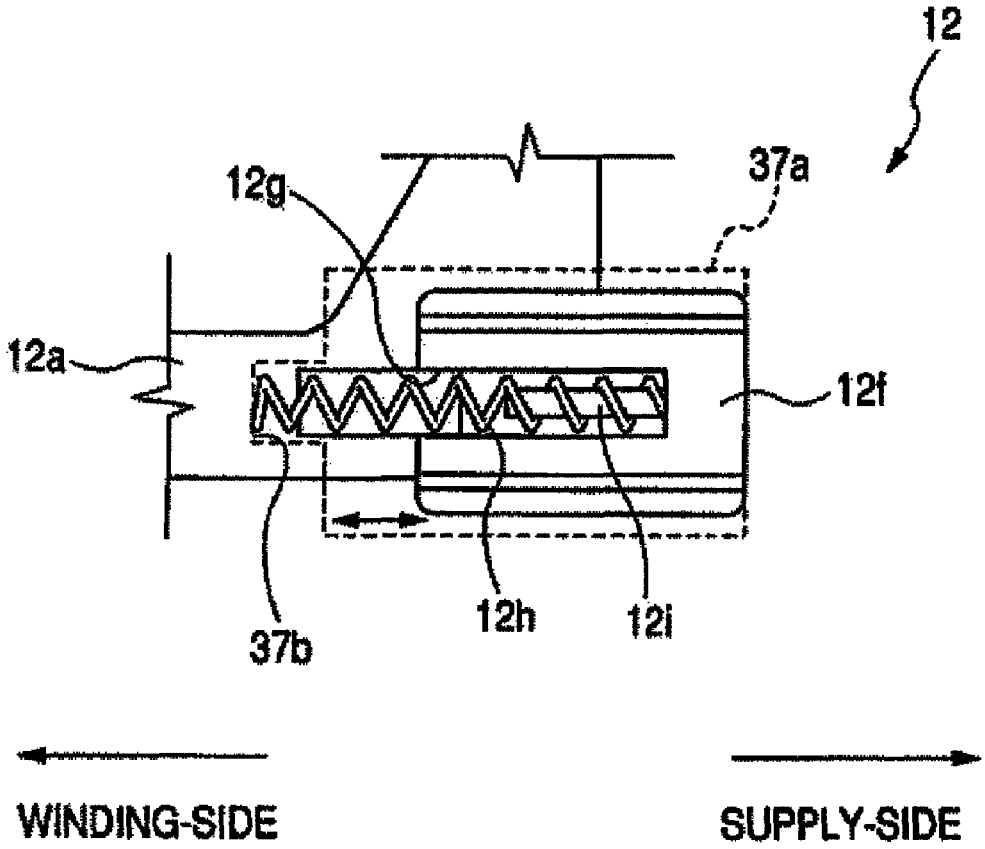
FIG. 9 is a top plan view illustrating a main part of the holding member as viewed from the supporting sidewall portion in the cartridge case as shown in FIG. 2.

On an end of the base portion 12*a*, as shown in FIG. 9, a convex portion 12*f* is formed so as to protrude toward the supporting-side sidewall portion 37. The convex portion 12*f* formed in a ⊃ shape causes a ⊃-shaped opening 12*g* to be formed toward the winding side. Additionally, a spring supporting member 12*i* is disposed inside the opening 12*g* of the convex portion 12*f* and an end of the spring member 12*h* is attached to the spring supporting member 12*i*.

A concave portion 37*a* movably fits within the convex portion 12*f*, and is formed on the inner surface of the supporting-side sidewall portion 37 opposite to the convex portion 12*f*, and the convex portion 12*f* is moveable between the supply side and the winding side in the concave portion 37*a*. In addition, a concave portion 37*b* supporting the other end of the spring member 12*h* is formed on the concave portion 37*a* opposite to the opening 12*g* of the convex portion 12*f* when the convex portion 12*f* of the holding member 12 is movably inserted into the concave portion 37*a*.

When the holding member 12 moves to the winding side, the convex portion 12*f* of the holding member 12 in the concave portion 37*a* of the supporting-side sidewall portion 37 moves to the winding side, and the spring member 12*h* shrinks correspondingly. When the holding member 12 does not move to the winding side, the convex portion 12*f* moves to the supply side in the concave portion 37*a* with the restoring force of the spring member 12*h* such that the holding member 12 is biased to the supply side.

Each locking claw 12*d* has a locking portion 12*c* and protrudes from a lower end of the arm portion 12*b* on the position corresponding to each locking protrusion 10*d* that is formed on the supporting-side wall 10*b* of the arm portion 12*b*. On an edge of the locking claw 12*d*, a guiding slope 12*e* is formed by a slope angle intersecting at an acute angle in a direction of movement to the winding side of the holding member 12. The guiding slope 12*e* thus guides the locking protrusion 10*d* to the locking portion 10*c* while moving the holding member 12 to the sheet winding bobbin 22 at the time the supply side sheet case 6 abuts against the locking protrusion 10*d* when the sheet supply dome portion 33 receives the supply-side sheet case 6.

An example of a method of inserting the ink sheet unit 2 into the cartridge case 3 will now be described.

First, an example of a method of inserting the supply-side sheet case 6 into the supply dome portion 33 will be described.

As shown in FIG. 3, when the supply-side sheet case 6 is disposed in the supply dome portion 33, each locking protrusion 10*d* of the supply-side sheet case 6 abuts against each guiding slope 12*e*. When the supply-side sheet case 6 is inserted in the sheet supply dome portion 33, each locking protrusion 10*d* is guided to the locking portion 12*c* of the locking claw 12*d* along the guiding slope 12*e*, and the holding member 12*a* moves to the winding side of the cartridge case 3 against the bias force of the spring member 12*h*. As shown in FIG. 4, when each locking protrusion is locked to the locking portion of each locking claw (with the restoring force of the spring member 12*h*), the holding member 12*a* moves to the supply side on which the sheet supply bobbin 21 of the cartridge case 3 is disposed so as to return to an original position.

The supply-side sheet case 6 is accordingly locked as each locking protrusion 10*d* thereof is locked to each locking claw 12*d* on the supporting-side wall 10*b* side, and each locking claw 12*d* presses each locking protrusion 10*d* with the bias force of the holding member 12, thereby fixing the final position of each locking protrusion 10*d* after locking. In addition, in the driving-side sidewall 11*b*, the driving shaft 21*c* is held in the bearing 35*a* of the driving-side sidewall portion 35, thereby holding the driving shaft 21*c* inside the supply dome portion 33 of the cartridge case 3.

According to the above description, when the sheet supply bobbin 21 is inserted in the reception portion of the sheet supply bobbin 21, an unused ink sheet wound around the sheet supply bobbin 21 is drawn out and extends to the opening portion 32 of the case body 31 which is opened as a transport path.

An example of a method of inserting the sheet winding bobbin 22 into the winding dome portion 34 will now be described.

The driving shaft 22*c* of the sheet winding bobbin 22 is introduced into the bearing 36*a* of a hole shape formed on the driving-side sidewall portion 36 so as to rotatably slide by disposing the sheet winding bobbin 22 of the ink sheet unit 2 in the sheet winding dome portion 34 of the cartridge case 3 (FIGS. 5 and 6).

By sliding an end of the supporting shaft 22*b* that abuts against the guiding wall surface of the guiding protrusion 42*b*, the central wall portion 42 is enabled to flex toward the outer wall portion 38 and engage the U-shaped bearing 40*a* formed on the inner wall portion 40. At this time, a user can enable the central wall portion 42 to be flexible toward the outer wall portion 38 against the pressing force of the spring member 44 by gripping the gripper portion formed on an end thereof.

When an end of the supporting shaft 22*b* is out of the guiding wall surface of the guiding protrusion 42*b* and is in the bearing 40*a*, the central wall portion 42 is pressed back to the inner wall portion 40 with the flexible restoring force thereof. With the restoring force of the spring member 44, the sheet winding bobbin 22 in the inner surface of the central wall portion 42 is biased against the driving-side sidewall portion 36, and the sheet winding bobbin 22 is held in the winding dome portion 34. Likewise, as the sheet winding bobbin 22 is biased in a direction of the driving-side sidewall portion 36 the flange 22*e* is placed in contact with the driving sidewall 36 of the cartridge case 3, and the rectangular grooves 22*f* formed on the outer wall surface of the flange 22*e* receive at least one gripping protrusion (not shown) formed on the driving-side sidewall portion 36. An idle rotation of the sheet winding bobbin 22 is thereby prevented when the cartridge case is not inserted into the printer, as is the looseness of the ink sheet 23.

Accordingly, when the ink sheet cartridge 1 receives the ink sheet unit 2 within the cartridge case 3, the ink sheet unit 2 is inserted into a predetermined position of the printer, making it ready to print.

Next, an example of a method of detaching the ink sheet unit 2 from the cartridge case 3 is described. Advantageously, the method provides for recovery of a used up sheet winding bobbin 22 from the winding dome portion 34. The user: enables the central wall portion 42 to flex toward the outer wall 38 against the pressing force of the spring member 44 by gripping the gripper portion formed on the end thereof; takes out the supporting shaft 22*b* from the U-shaped bearing 40*a* of the inner wall portion 40 while the guiding protrusion 42*b* and the supporting shaft 22*b* are disengaged; and continuously releases the slide of the driving shaft 22*c* with respect to the bearing 36*a* formed on the driving-side sidewall portion 36.

Next, the supply-side sheet case 6 of the ink sheet unit 2 is detached from the supply dome portion 33 of the cartridge case 3.

As shown in FIG. 7, while moving the base portion 12*a* of the holding member 12 to the winding side against the bias force of the spring member 12*h*, and while moving the supply-side sheet case 6 in a direction separate from the supply dome portion 33, the user unlocks each locking protrusion 10*d* of the supply-side sheet case 6 from the locking portion 12*c* of each locking claw 12*d* in the cartridge case 3, and detaches the driving shaft 21*c* from the bearing 35*a* of the driving-side sidewall portion 35. Accordingly, the supply-side sheet case 6 of the ink sheet unit 2 is detached from the supply dome portion 33 of the cartridge case 3.

Additionally, when the force of the base portion 12*a* toward the winding side is off, the holding member 12 moves toward the supply side so as to return to an original position by way of a restoring force of the spring member 12*h* (FIG. 8).

In the ink sheet cartridge 1 of one embodiment, the outer wall surface of the case body 31 faces upside down at the time of insertion into the printer. That is, the ink sheet cartridge 1 is formed in a semi-open type structure so as to receive and hold the ink sheet unit 2 in the upper half of the above-mentioned known ink sheet cartridge.

In addition, as the part wound around the sheet supply bobbin 21 of the ink sheet 23 is coated with the supply-side sheet case 6, direct touching of the unused part of the coloring region of the ink sheet 23 with a hand or foreign object can be prevented at the time of replacing and recovering the ink sheet unit 2.

Accordingly, labor and skill is not required to disassemble the cartridge case 3 of the ink sheet cartridge 1 having a semi-open type structure, thereby making it easier to replace and recover the ink sheet unit 2. Additionally, the cartridge case 3 can be reused, and thus running costs are reduced as well.

Additionally, it is possible to prevent foreign substances such as dust or the like from attaching on the unused part of the coloring region of the ink sheet 23, thus preventing a transfer failure of the ink from the ink sheet 23 caused by such attachment. The result is a higher quality print. It is also possible to prevent a hand or other foreign object from polluting the coloring region at the time of replacing and recovering the ink sheet unit 2.

Also, at the time of using the ink sheet cartridge, the locking surface of the guiding protrusion 42*b* formed on the central wall portion 42 is locked to an end of the supporting shaft 22*b* of the sheet winding bobbin 22, and the supporting shaft 22*b* is controlled in the bearing 40*a*, thereby preventing the supporting shaft 22*b* of the sheet winding bobbin 22 from separating from the bearing 40*a*. Each locking protrusion 10*d* of the supply-side sheet case 6 is locked to each locking claw 12*d* of the holding member 12*a*. Each locking protrusion 10*d* is pushed by each locking claw 12*d* because of the bias force of the holding member 12, thereby fixing the position of each locking protrusion 10*d* after locking. Accordingly, the supply-side sheet case 6 is firmly held in the supply dome portion 33 of the cartridge case 3. Because two locking protrusions 10*d* are locked to the corresponding two locking claws 12*d*, it is possible to prevent the supply-side sheet case 6 from moving in the supply dome portion 33 of the cartridge case 3, thereby more securely holding the supply-side sheet case 6 in the supply dome portion 33 of the cartridge case 3.

Furthermore, when unlocking the spring member 44 with a certain shock at the time of detaching the sheet winding bobbin 22 from the cartridge case 3 (for the purpose of replacing the ink sheet unit 2, for instance), it is possible to prevent the spring member 44 from protruding from the ink sheet cartridge 1 by using the protrusion 49 that causes the spring member 44 to protrude toward the space directly above the spring member 44. Additionally, loss of the spring member 44 can be prevented.

When the cartridge case 3 needs to be scraped because of prolonged usage of the ink sheet cartridge 1, the user can scrape the cartridge case 3 by sorting the metal spring member 44 and the resin cartridge case 3 after bending a connection part between the protrusion 49 disposed in the space above the spring member 44 and the outer wall portion 38.

Because the supply-side end opening portion 33*a* is formed on the part of the case body 31 of the cartridge case 3 opposed to the supply-side sheet case 6, the material needed to manufacture the case body 31 is reduced, as is the amount of waste when required to scrape the cartridge case 3.

Additionally, the invention is not limited to the above-described embodiment, and may be modified to various forms of the embodiment, if necessary.

For example, the part of the ink sheet 23 wound around the sheet supply bobbin 21 is received in the supply-side sheet case 6 in one embodiment, but the scope of the disclosure is not limited thereto. The portion wound around the sheet winding bobbin 22 may be received in a winding-side sheet case (not shown). In this case, a winding-side end opening portion may be formed on the part of the case body 31 of the cartridge case 3 opposed to the winding-side sheet case, thereby further reducing the manufacturing material and the time required to scrape the cartridge case 3.

Additionally, a holding mechanism which holds the ink sheet unit 2 in the cartridge case 3 is not limited to the above-described embodiment, and may be modified in various ways as recognized by one of skill in the art.

Additionally, the case body 31 of the cartridge case 3 is disposed to face the upper surface of the ink sheet unit 2 in the embodiment, but may by modified to be disposed to face the lower surface of the ink sheet unit 2.

The terms and descriptions used herein are set forth by way of illustration only and are not meant as limitations. Those skilled in the art will recognize that many variations can be made to the details of the above-described embodiments without departing from the underlying principles of the disclosure. The scope of the disclosure should therefore be determined only by the following claims (and their equivalents) in which all terms are to be understood in their broadest reasonable sense unless otherwise indicated.

What is claimed is:

1. An ink sheet cartridge comprising:

an ink sheet unit including a sheet supply bobbin on which a longitudinal ink sheet is wound from one end thereof and a sheet winding bobbin on which the longitudinal ink sheet is wound from the other end thereof;

a cartridge case to detachably receive the ink sheet unit, wherein the cartridge case comprises:

a case body having a central opening portion disposed opposite to a main surface of the ink sheet unit so as to expose the center of the ink sheet;

a driving sidewall portion disposed on one side of the case body so as to rotatably support driving shafts disposed on one end of the sheet supply and winding bobbins; and a supporting sidewall disposed on the other side of the case body so as to rotatably support supporting shafts disposed on the other end of the sheet supply and winding bobbins; and wherein the ink sheet unit includes a sheet case that receives the ink sheet wound around the sheet supply bobbin, wherein the ink sheet is drawn from the sheet supply bobbin of the sheet case to be wound around the sheet winding bobbin.

2. The ink sheet cartridge according to claim 1, wherein an end opening portion is formed in a part of the case body opposite from the sheet case to expose the sheet case and to facilitate retraction of the sheet case from the case body.

3. The ink sheet cartridge according to claim 1, wherein the case body is disposed on the main surface of the ink sheet unit such that, together the driving sidewall portion and the supporting sidewall, is formed a semi-open type structure that receives and holds the ink sheet unit when the cartridge case is inserted into a printer.

4. The ink sheet cartridge according to claim 1, wherein the driving sidewall portion comprises first and second driving sidewall portions corresponding, respectively, to the driving shafts disposed on the one end of the sheet supply and winding bobbins, and wherein the supporting sidewall comprises a supporting sidewall portion corresponding to the supporting shaft disposed on the other end of the sheet supply bobbin.

5. The ink sheet cartridge according to claim 4, further comprising:

a locking protrusion disposed on the supporting sidewall portion;

a holding member to hold the sheet case disposed on, and moveable in parallel with, an inner surface of a supporting sidewall of the case body; and wherein the holding member includes a locking claw having a locking portion to lock into the locking protrusion, a guiding slope being formed on an edge of the locking claw so as to guide the locking protrusion into the locking portion while moving the holding member to abut against the locking protrusion when the cartridge case receives the ink sheet unit.

6. The ink sheet cartridge according to claim 5, wherein a locking aperture is defined longitudinally within the holding member in a direction along the length of the holding member, and wherein a locking clamp protrudes from the supporting sidewall, the locking clamp insertable into the locking aperture to lock the holding member to the supporting sidewall substantially simultaneously with the locking portion of the locking claw being locked into the locking protrusion.

7. The ink sheet cartridge according to claim 5, wherein within a base portion of the holding member is defined a convex portion slidably insertable into a corresponding concave portion defined in the supporting sidewall, and wherein an opening is defined through the convex portion to receive a spring therein, the spring to bias the holding member, and thus the sheet case, against the sheet supply bobbin end of the case body.

8. The ink sheet cartridge according to claim 4, wherein the sheet case comprises upper and lower halves that are separable to remove the sheet supply bobbin, wherein the first driving sidewall portion is disposed on one end of the sheet case, and the supporting sidewall portion is disposed on the other end of the sheet case.

9. The ink sheet cartridge according to claim 8, wherein the sheet case comprises an upper side bearing connected to the inner wall of the first supporting sidewall portion to rotatably support the supporting shaft of the sheet supply bobbin.

10. The ink sheet cartridge according to claim 8, wherein at least the first and the second driving sidewall portions comprise a plurality of gripping protrusions corresponding to, and for reception of, a plurality of grooves defined in respective driving shafts of the sheet supply and winding bobbins.

11. An ink sheet cartridge comprising:

a sheet case having a first driving sidewall portion coupled to a first end of the sheet case and a first supporting sidewall portion coupled to a second end of the sheet case to rotatably support, respectively, corresponding driving and supporting shafts of a sheet supply bobbin located within the sheet case;

a case body having supply and winding dome portions at respective first and second ends thereof, the supply dome portion for detachable insertion therein of the sheet case through an end opening portion of the case body, and the winding dome portion for detachable insertion therein of a sheet winding bobbin;

a second driving sidewall portion coupled to a first side of the winding dome portion, and a second supporting sidewall portion coupled to a second side of the winding dome portion to rotatably support, respectively, corresponding driving and supporting shafts of the winding supply bobbin; and an ink sheet having a first end wound around the sheet supply bobbin and threaded through a central slit opening defined along the side of the sheet cases and having a second end wound around the sheet winding bobbin.

12. The ink sheet cartridge according to claim 11, wherein the driving and supporting sidewall portions include corresponding flanges to facilitate rotatable support of respective sheet supply and winding bobbins.

13. The ink sheet cartridge according to claim 11, further comprising:

a locking protrusion disposed on the first supporting sidewall portion;

a holding member to hold the sheet case disposed on, and moveable in parallel with, an inner surface of a the second supporting sidewall portion; and wherein the holding member includes a locking claw having a locking portion to lock into the locking protrusion, a guiding slope being formed on an edge of the locking claw so as to guide the locking protrusion into the locking portion while moving the holding member to abut against the locking protrusion when the cartridge case receives the ink sheet unit.

14. The ink sheet cartridge according to claim 13, wherein a locking aperture is defined longitudinally within the holding member in a direction along the length of the holding member, and wherein a locking clamp protrudes from the supporting sidewall, the locking clamp insertable into the locking aperture to lock the holding member to the second supporting sidewall portion substantially simultaneously with the locking portion of the locking claw being locked into the locking protrusion.

15. The ink sheet cartridge according to claim 13, wherein within a base portion of the holding member is defined a convex portion slidably insertable into a corresponding concave portion defined in the second supporting sidewall portion, and wherein an opening is defined through the convex portion to receive a spring therein, the spring to bias the holding member, and thus the sheet case, against the first end of the case body.

16. The ink sheet cartridge according to claim 11, wherein an ink sheet unit comprises the sheet case having therein the sheet supply bobbin, the sheet winding bobbin, and the ink sheet, wherein the ink sheet unit is detachable from the case body.

17. The ink sheet cartridge according to claim 16, wherein the sheet case comprises an upper side bearing connected to the inner wall of the first supporting sidewall portion to rotatably support the first supporting sidewall portion of the sheet supply bobbin.

18. The ink sheet cartridge according to claim 11, wherein the second supporting sidewall portion comprises:

an outer wall portion;

an inner wall portion spaced from the outer wall portion to form a gap therebetween;

a central wall portion disposed substantially parallel with and between the outer and inner walls;

a U-shaped bearing opened at the end of the inner wall portion so that the second supporting shaft slides therein; and a spring member biased between the outer and central walls, to thereby bias the sheet winding bobbin against the second driving sidewall portion.

19. The ink cartridge according to claim 18, further comprising:

a convex-shaped locking portion defined in the inner wall surface of the outer wall portion to receive one end of the spring member; and a convex-shaped locking portion defined in the outer wall surface of the central wall portion to receive the other end of the spring member.

20. The ink cartridge according to claim 18, wherein the central wall portion is cantilevered from the area of the supporting shaft to an end thereof to allow the central wall portion to flex with the spring member when removing the sheet winding bobbin.

21. The ink cartridge according to claim 20, further comprising:

a protrusion having a base attached to the inner wall surface of the out wall portion, and a distal end thereof extending against the spring member to deflect the spring member toward the case body to prevent loss thereof when replacing an ink sheet unit comprising the sheet winding bobbin.

* * * * *

UNITED STATES PATENT AND TRADEMARK OFFICE

CERTIFICATE OF CORRECTION

PATENT NO. : 7,808,518 B2
APPLICATION NO. : 11/689928
DATED : October 5, 2010
INVENTOR(S) : Takashi Nakai et al.

It is certified that error appears in the above-identified patent and that said Letters Patent is hereby corrected as shown below:

In the Claims

Column 12, claim 11, line 21, after "along the side of the sheet" replace "cases," with --case,--.

Signed and Sealed this
First Day of February, 2011

David J. Kappos

David J. Kappos
*Director of the United States Patent and Trademark Office*